US005816488A

United States Patent [19]

Moeder

[11] Patent Number: 5,816,488

[45] Date of Patent: Oct. 6, 1998

[54] FOOD PACKAGING TRAY

[75] Inventor: Claudio Moeder, Voghera, Italy

[73] Assignee: FRA. Mo Snc di Franca Riva & C, Voghera, Italy

[21] Appl. No.: 765,145

[22] PCT Filed: Jun. 7, 1995

[86] PCT No.: PCT/GB95/01319

§ 371 Date: Mar. 25, 1997

§ 102(e) Date: Mar. 25, 1997

[87] PCT Pub. No.: WO96/01218

PCT Pub. Date: Jan. 18, 1996

[30] Foreign Application Priority Data

Jul. 6, 1994 [GB] United Kingdom ..... 9413645

[51] Int. Cl.[6] ..... B65D 1/34; B65D 1/40

[52] U.S. Cl. ..... 229/406; 220/468; 229/407; 264/154; 264/155

[58] Field of Search ..... 229/406, 407; 220/468, 469; 426/129; 264/154–156, 299, 319, 320

[56] References Cited

U.S. PATENT DOCUMENTS

| | | | |
|---|---|---|---|
| 3,264,120 | 8/1966 | Westcott | 220/469 |
| 3,396,430 | 8/1968 | Westcott . | |
| 3,756,681 | 9/1973 | Croston | 426/129 |
| 4,104,349 | 8/1978 | Hillgenberg | 264/155 |
| 4,896,790 | 1/1990 | Gronnevik | 220/469 |
| 4,940,621 | 7/1990 | Rhodes et al. | 426/129 |
| 4,949,897 | 8/1990 | Pawlak et al. | 426/129 |
| 5,078,948 | 1/1992 | Troutman et al. | 264/154 |
| 5,353,930 | 10/1994 | Berry, Jr. | 264/154 |
| 5,626,090 | 5/1997 | Thompson et al. | 264/154 |

FOREIGN PATENT DOCUMENTS

| | | | |
|---|---|---|---|
| 661027 | 4/1963 | Canada | 229/407 |
| 495230 | 12/1991 | European Pat. Off. . | |
| 331254 | 12/1970 | Sweden | 229/407 |
| 8607036 | 12/1996 | WIPO . | |

*Primary Examiner*—Gary E. Elkins
*Attorney, Agent, or Firm*—Howard & Howard

[57] ABSTRACT

A packaging tray for use with food such as meat or fish formed from a hollow plastics material board, the base portion (14) of the tray having holes (16) formed in the upper portion thereof and the holes having a lip (18) which is at least partly removed on the top side. The tray is preferably formed from corrugated plastics material sheet of a recyclable material such as polyolefin. The holes are star-shaped and channels are formed through the lip in the interstices between adjacent points of the star allowing liquor to drain into the interior of the board but not back out again.

8 Claims, 2 Drawing Sheets

FOOD PACKAGING TRAY

This invention relates to a tray for packaging food and in particular to a tray for packaging foods prone to dripping exudates, such as meat, fish, salads and the like.

Foods such as meat and fish are commonly packaged, especially for supermarkets, in moulded expanded polystyrene trays covered with shrink wrap film. Because foods such as meat and fish produce an exudate or liquor (such as blood) it is common to put an absorbent pad on the tray immediately below the product to absorb excess liquor. However, the continuing presence of a pad soaked in a liquor such as blood adjacent the product can constitute a health hazard. Moreover, expanded polystyrene does not lend itself easily to recycling.

In an alternative form of tray more recently proposed, an absorbent pad is sandwiched between two sheets of polystyrene in the tray bottom, the upper sheet having holes to allow the liquor through to the pad. This has the advantage that the pad is kept out of contact with the product, but this form of tray is very expensive to produce and still suffers from the disadvantage that expanded polystyrene is not easily recyclable.

The invention seeks to provide a form of tray for use with meat and fish improved in the above respects.

According to the present invention there is provided a packaging tray for use with food such as meat or fish formed from a hollow plastics material board, the base portion of the tray having holes formed in the upper portion thereof and the holes having a lip which is at least partly removed on the top side.

Preferably, the trays are formed from corrugated plastics material sheet such as that described in European patent publication number 0 339 593, and is made of a recyclable material such as polyolefin. The sheet will be moulded into the form of a tray suitable for carrying the relevant product and may in many respects be similar in shape to the current polystyrene trays for meat and fish products. The holes formed in the upper surface of the bottom of the tray will give access to the interior of the hollow sheet or board Forming the holes by means such as a hot pin will normally leave a lip around the hole both above and below the upper and lower surfaces respectively of the top layer. In accordance with the invention means such as an ultrasonic electrode or a heated probe is employed to provide channels through the lip in the upper surface only so that liquor can drain easily from the bottom of the tray through the holes into the interior of the hollow sheet or board. However, because the lip on the underside of the holes is intact, liquor will not normally be able to drain back into contact with the food even if the tray is inverted. No absorbent pad is needed.

Preferably, the holes are star-shaped and the channels referred to above are formed in the interstices between adjacent points of the star.

The invention will be described, by way of example, with reference to the accompanying drawings, in which.

Figure 1:
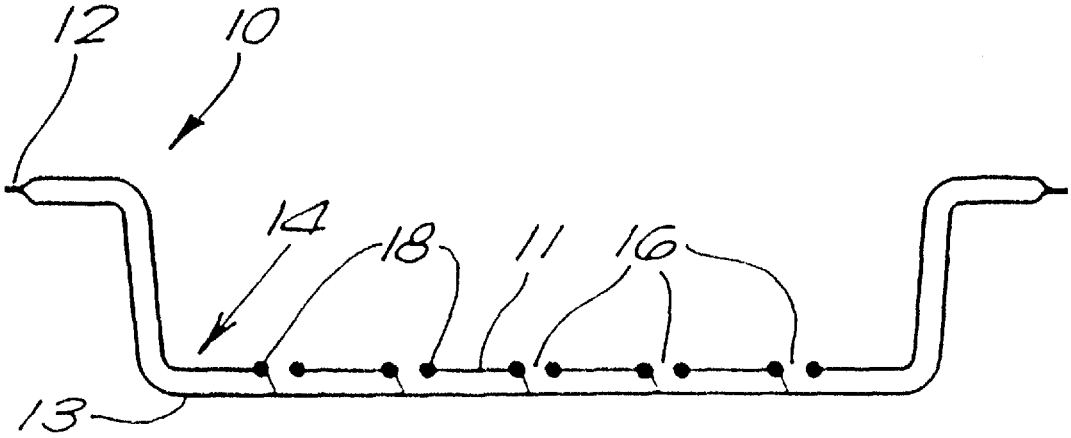
FIG. 1 is a diagrammatic sectional view of a tray in accordance with the invention.
Figure 2:
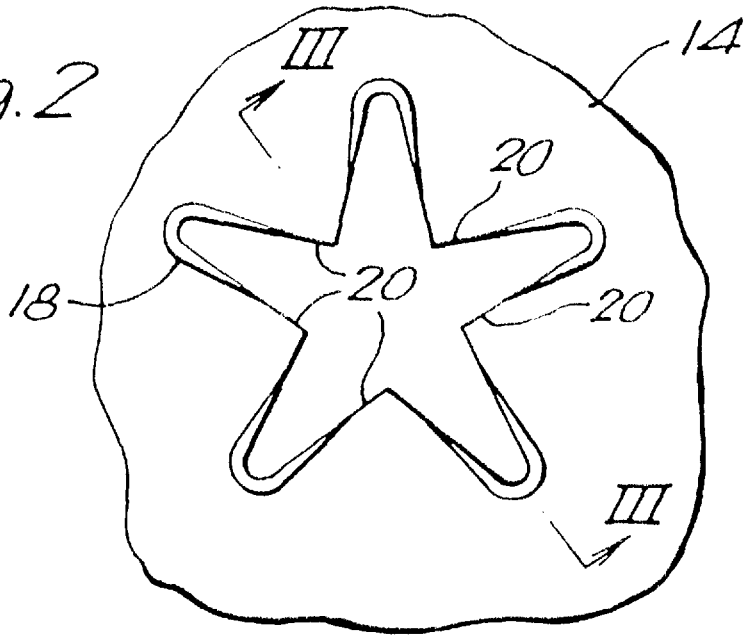
FIG. 2 is a plan view on an enlarged scale of a portion of the base or the tray illustrating a hole.
Figure 3:
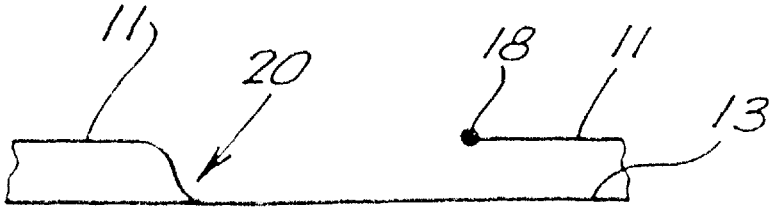
FIG. 3 is a section on line III—III in FIG. 2.

Referring to the drawings, in particular FIGS. 1 to 3, a tray generally designated 10 for the packaging of foods such as meat or fish which exude liquor is formed from a corrugated polyolefin sheet material by moulding. The sheet thus has an upper layer 11 and a lower layer 13. The edges 12 are sealed as illustrated. The tray has a base 14 on which the food product (not shown) is placed, and this is provided with a number of holes 16 which are generally star-shaped in plan (see FIG. 2).

The holes 16 are formed in the upper layer 11 by using a heated pin or die and, accordingly, a lip 18 of the thermoplastic material forms around the hole. The lip extends both upwardly of the upper layer of the base 14 and below the upper layer in approximately equal amounts. This lip would prevent to a great extent liquor from the food material transferring into the hollow interior portion of the tray 10. Accordingly, at the interstices 20 or the star-shaped hole 16 an ultrasonic electrode (such as a 'Sonotrode') is used to partially remove the lip 18, seal the upper layer 11 at the interstices 20 to the bottom layer 13, and create channels so that any liquor on the lower surface 14 can easily transfer through into the hollow interior portion of the tray 10. Alternatively, a heated pin or probe can be used for this purpose. However, the lip remaining on the underside of the hole 16 is not affected. Accordingly, this is effective to prevent any liquor from the interior re-transferring to the food area of the tray even if the tray is inverted.

Figure 4:
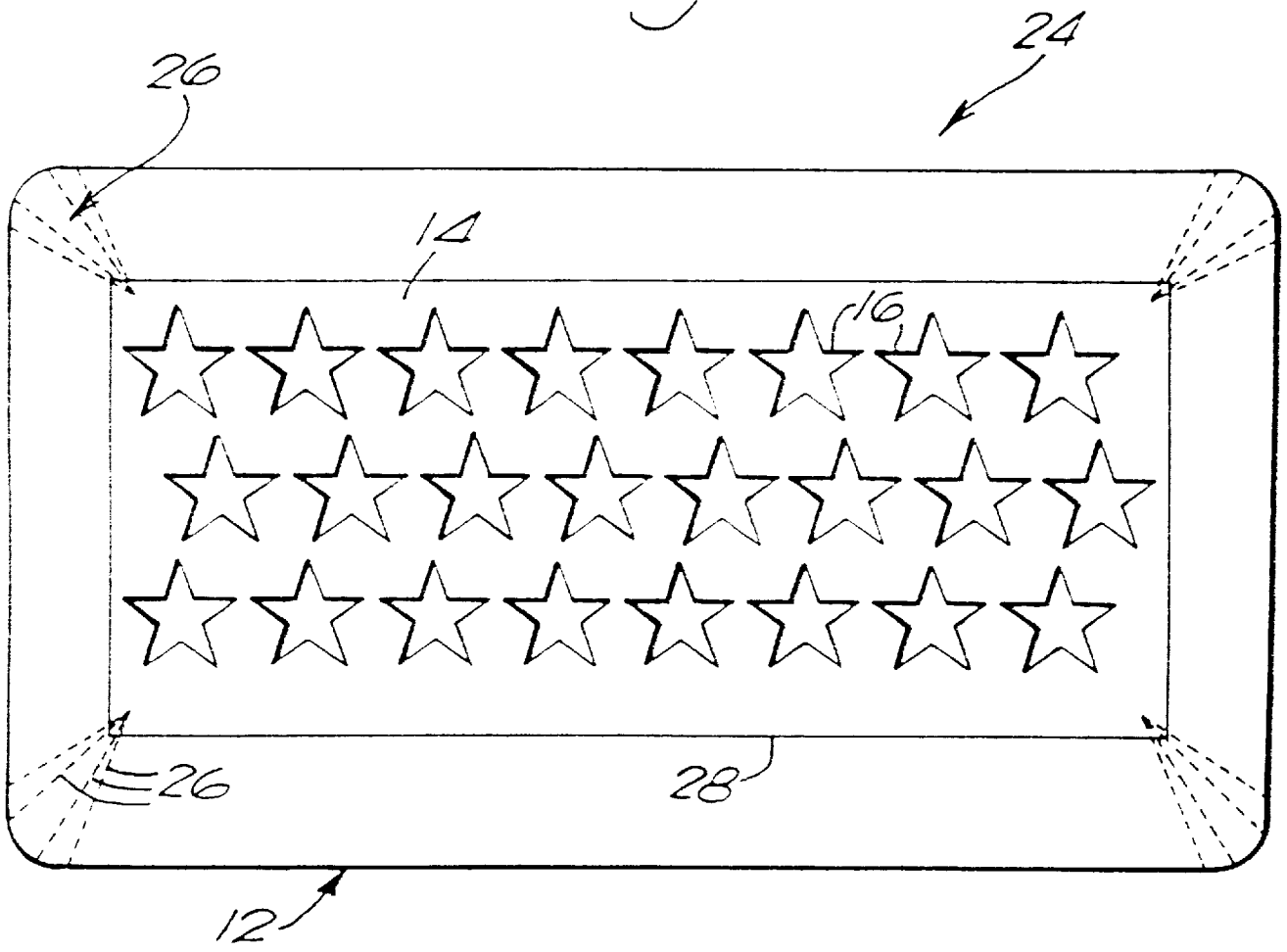
FIG. 4 is a top plan view of a tray blank.

Referring now to FIG. 4, while the basic tray shape can be made by one-shot thermoforming of a plastics alveolate material, it can also be made from a flat blank as illustrated in FIG. 4. This can easily be made into a tray by the supplier or user, but pacs flat for easy transport and storage. Using like numerals for like parts, the flat blank, generally designated 24, has score lines 26 in each corner. By heating only the corners and overlapping the creased areas the tray can easily be formed. As before, the perimeter 12 of the tray 24 is sealed, as is the inner perimeter 28, to entrap air and increase mechanical resistance. The tray has star shaped holes 16 as described above.

Thus the tray in accordance with the invention does not require the presence of an absorbent pad, is inexpensive to produce, and may be produced from recyclable plastics materials. It nevertheless separates any liquor or exudate from the product packaged and lowers the chance of contamination of the product through contact with liquor which may have become infected.

I claim:

1. A packaging tray for use with food formed from a hollow plastics material board having a base portion with an upper layer and a lower layer, the base portion of the tray having holes formed in the upper layer, said tray characterized by the holes having lips (18) extending upwards and downwardly of the upper layer (11) and having channels (20) through the upwardly extending lips only while the downwardly extending lips remain unaffected.

2. A tray as claimed in claim 1 formed from corrugated plastics material sheet.

3. A tray as claimed in either of claims 1 made of a recyclable material.

4. A tray as claimed in any of claims 1 to 3 in which the holes are star-shaped and channels are formed through the lip in the interstices between adjacent points of the star.

5. A tray as claimed in claim 4 in which, in area of the channels, the upper layer is sealed to the lower layer of the board.

6. A tray as claimed in claim 1 in which the tray has a perimeter and the base has a perimeter which are sealed to entrap air and increase mechanical resistance.

7. A method of making a tray of the type formed from a hollow plastics material board having a base portion with an upper layer and a lower layer, the base portion of the tray having holes formed in the upper layer;

the holes having lips (18) extending upwards and downwardly of the upper layer (11) and having channels (20) through the upwardly extending lips only while the downwardly extending lips remain unaffected, and comprising the steps of forming the holes by means of a hot pin or die and leaving a lip around the hole both above and below the upper and lower surfaces respectively of the top layer and thereafter creating channels through the lip in the upper surface only.

8. A method as claimed in claim 7 in which the tray is formed from a flat blank having score lines at each corner.

* * * * *